US005307868A

United States Patent [19]

Barbaud

[11] Patent Number: 5,307,868

[45] Date of Patent: May 3, 1994

[54] DEVICE FOR PREVENTING CHOKING IN PLATE HEAT EXCHANGERS

[75] Inventor: Jean Barbaud, Sainte Foy Les Lyon, France

[73] Assignee: Electricite de France-Service National, Paris, France

[21] Appl. No.: 981,853

[22] Filed: Nov. 24, 1992

[51] Int. Cl.[5] ..... F28F 19/00

[52] U.S. Cl. ..... 165/119; 165/103; 251/129.04

[58] Field of Search ..... 165/119, 103, 167; 251/129.04

[56] References Cited

U.S. PATENT DOCUMENTS

| | | | |
|---|---|---|---|
| 3,605,881 | 9/1971 | Doi | 165/167 |
| 3,690,373 | 9/1972 | Wright | 165/119 |
| 4,410,029 | 10/1983 | Klaren | 165/103 |
| 4,590,994 | 5/1986 | Champion | 165/119 |
| 4,790,514 | 12/1988 | Marks | 251/129.04 |
| 4,838,310 | 6/1989 | Scott et al. | 251/129.04 |

FOREIGN PATENT DOCUMENTS

| | | | |
|---|---|---|---|
| 2613835 | 10/1976 | Fed. Rep. of Germany | 165/119 |
| 892333 | 4/1944 | France | 165/119 |
| 188999 | 11/1982 | Japan | 165/119 |
| 1225514 | 4/1986 | U.S.S.R. | 165/119 |
| 1207919 | 10/1970 | United Kingdom . | |

*Primary Examiner*—John Rivell
*Assistant Examiner*—L. R. Leo
*Attorney, Agent, or Firm*—Sughrue, Mion, Zinn, Macpeak & Seas

[57] ABSTRACT

The present invention relates to a plate heat exchanger consisting of a stack of plates (21) clamped against each other in a sealed manner with a sealing joint being intercalated so as to create fluid flow channels between these plates, each plate comprising four holes forming with the holes of the other plates four manifolds (26,27), namely two inlet manifolds and two outlet manifolds, the ends of these manifolds being connected, on one side of the stack, to inlet or outlet pipework (28,29), so as to create two distinct fluid circuits, the joints enabling the channels to communicate with one or the other of the said fluid flow circuits, characterised in that at least one of the two inlet manifolds (26) is provided with a peripheral filtering cartridge (33), the mesh size of which is less than or equal to the distance between two contiguous plates (21), and is connected, at its opposite end to the inlet pipework (28), to the corresponding outlet pipework (29) by a pipe (31) controlled by a valve (32).

Application to the auxiliary cooling circuits of power stations.

10 Claims, 4 Drawing Sheets

DEVICE FOR PREVENTING CHOKING IN PLATE HEAT EXCHANGERS

BACKGROUND OF THE INVENTION

Plate heat exchangers are well known for producing a heat exchange between two fluids. They consist of a stack of plates clamped against each other in a sealed manner with a sealing joint being intercalated so as to create fluid flow channels between these plates, each plate comprising four holes forming with the holes of the other plates four manifolds, namely two inlet manifolds and two outlet manifolds, the ends of these manifolds being connected, on one side of the stack, to inlet or outlet pipework, so as to create two distinct fluid circuits, the joints enabling the channels to communicate with one or the other of the said fluid flow circuits.

Generally, the channels formed between the plates are, by virtue of the abovementioned joints, allocated to one or the other of the fluid circuits with a configuration alternating from one channel to the other. The inlet and outlet pipes are arranged along a diagonal of the plates which have a rectangular shape. In addition, the inlet pipework of a circuit is arranged on the same small side of the rectangle as the outlet pipework of the second circuit such that the two fluids flow in opposite directions. The opposite ends of the manifolds to the connection with the inlet or outlet pipework are closed off.

These heat exchangers are very efficient but they have the disadvantage of being choked by the impurities conveyed by the fluids. In particular, in the case of the auxiliary cooling circuits of a power station, the cooling fluid consists of untreated water which contains impurities.

When debris having dimensions which are greater than the distance separating two neighbouring plates, that is to say the thickness of the flow channel, are trapped in the inlet manifold and when there is a considerable quantity of these debris, the exchanger is choked and becomes unusable.

The problem of periodically unchoking the plate heat exchangers of the abovementioned type therefore arises.

A first solution consists in reversing the flow direction of the fluid in the choked circuit; this first method greatly complicates the layout of the pipework and requires the installation of three valves.

A second solution involves an at least partial dismantling in order to extract therefrom the debris which have become caught between the plates. This last solution results in a considerable labour cost and in a relatively long time during which the exchanger is unusable.

Another solution consists in installing a filter upstream of the inlet manifold. This solution is relatively costly and complex to install.

SUMMARY OF THE INVENTION

The present invention therefore aims to provide a plate heat exchanger which is prevented from being choked.

The subject of the invention is a plate heat exchanger consisting of a stack of plates clamped against each other in a sealed manner with a sealing joint being intercalated so as to create fluid flow channels between these plates, each plate comprising four holes forming with the holes of the other plates four manifolds, namely two inlet manifolds and two outlet manifolds, the ends of these manifolds being connected, on one side of the stack, to inlet or outlet pipework, so as to create two distinct fluid circuits, the joints enabling the channels to communicate with one or the other of the said fluid flow circuits, characterised in that at least one of the two inlet manifolds is provided with a peripheral cylindrical filtering cartridge, the mesh size of which is less than or equal to the distance between two contiguous plates, and is connected, at its opposite end to the inlet pipework, to the corresponding outlet pipework by a pipe controlled by a valve.

The valve is normally closed during the operation of the exchanger and the flow in the two circuits takes place exactly in the same way as in a conventional exchanger. When the valve is opened, the debris which have been caught by the filtering cartridge are discharged by the current of the fluid which flows along the inlet manifold and returns directly to the outlet pipework.

Advantageously, the abovementioned pipe is connected to the opposite end of the outlet manifold to the outlet pipework.

In this way, the space required is reduced since the operation simply involves adding a pipe provided with a valve to the rear of the plate heat exchanger, which is a location where there is a lot of available space without adding to the bulk of the exchanger.

According to one embodiment of the invention, the filtering cartridge consists of a screen comprising transverse rods which are assembled by rings and the distance separating two contiguous rods is less than or equal to the distance between two contiguous plates.

The fact that the filtering cartridge consists of rods arranged in the flow direction of the fluid enables the discharge of the debris caught by the filtering cartridge to be facilitated during the unchoking operation.

Other characteristics and advantages of the invention will emerge from the following description of an embodiment of the invention, given with reference to the attached drawings in which:

DESCRIPTION OF PREFERRED EMBODIMENTS

Figure 1:
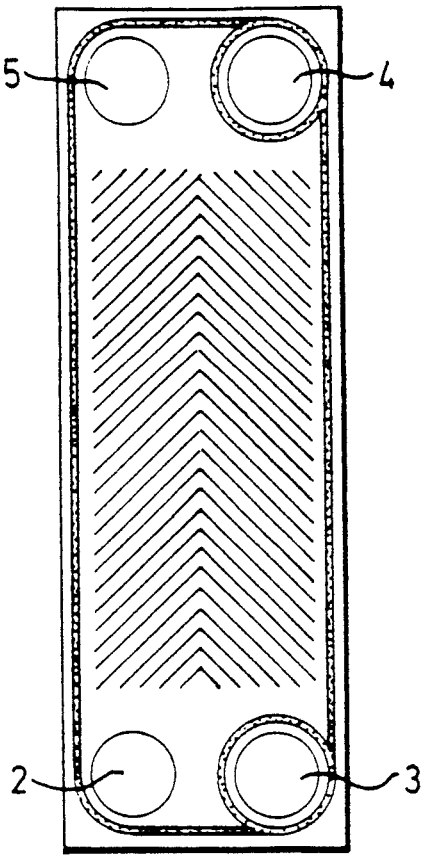
FIG. 1 (PRIOR ART)
FIG. 1 shows a front view of a plate of a plate heat exchanger of known type.
Figure 2:
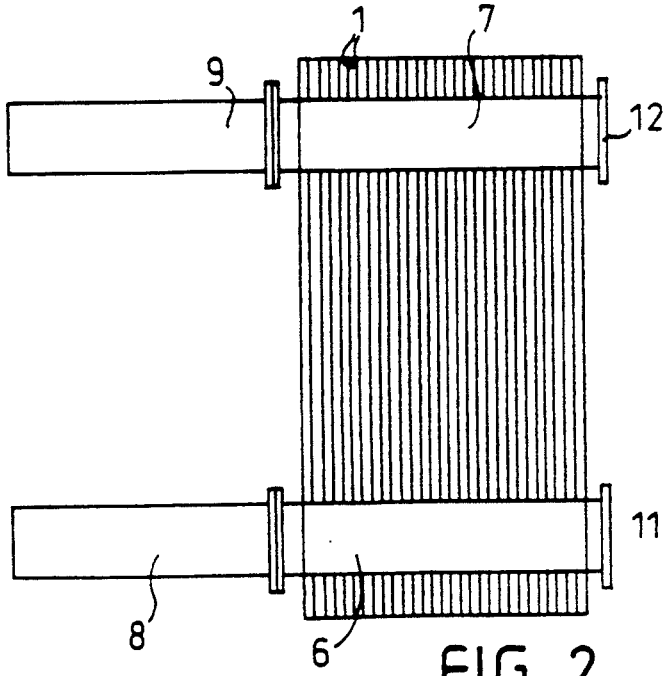
FIG. 2 (PRIOR ART)
FIG. 2 is a cross-sectional side view of an exchanger consisting of a stack of plates from FIG. 1.

FIGS. 1 and 2 show a plate heat exchanger of known type. It consists of a number of rectangular plates 1 which are stacked one on top of another with a joint being intercalated so as to form a fluid flow channel between two contiguous plates.

Each plate comprises four holes referenced 2, 3, 4 and 5 which are each arranged at a corner of the rectangle. The alignments of the holes of the plates in the stack define manifolds 6 and 7 (FIG. 2) which may be made to communicate with the channels formed between the plates.

The joints arranged between the plates are designed and arranged in such a way that each channel is made to communicate with two manifolds, an inlet manifold 6 arranged for example at the bottom of the plate and an outlet manifold 7 arranged on the other side of the plate, that is to say at its upper part.

The assembly of two manifolds and the channels which are connected to them constitutes a first fluid flow circuit. The other two manifolds are linked to the other channels so as to constitute the second fluid flow circuit.

Advantageously, the successive channels are connected alternately to one and to the other of the two circuits, the odd-numbered channels being allocated to a first circuit and the even-numbered channels to the other circuit.

In this way, heat exchange between the two fluids flowing in the two fluid flow circuits is brought about.

Advantageously, the two fluids flow in opposite directions, that is to say the inlet manifold of one of the circuits is located in the lower part of the exchanger and the inlet manifold of the other circuit is located in its upper part. In addition, in order to improve the heat exchange, the two manifolds of the same circuit may be diametrically opposite, that is to say, for example, the manifold consisting of the holes 2 constitutes the inlet manifold of a first circuit to which the outlet manifold consisting of the holes 4 is linked, whilst the inlet manifold of the circuit consists of the holes 5, the outlet manifold consisting of the holes 3.

Each manifold is connected to associated inlet 8 or outlet 9 pipework. Advantageously, all the inlet and outlet pipework is placed on the same side of the exchanger, on the left-hand side in the example shown. At the other end, the manifolds end with a closure plate 11 and 12 respectively.

Figure 3:
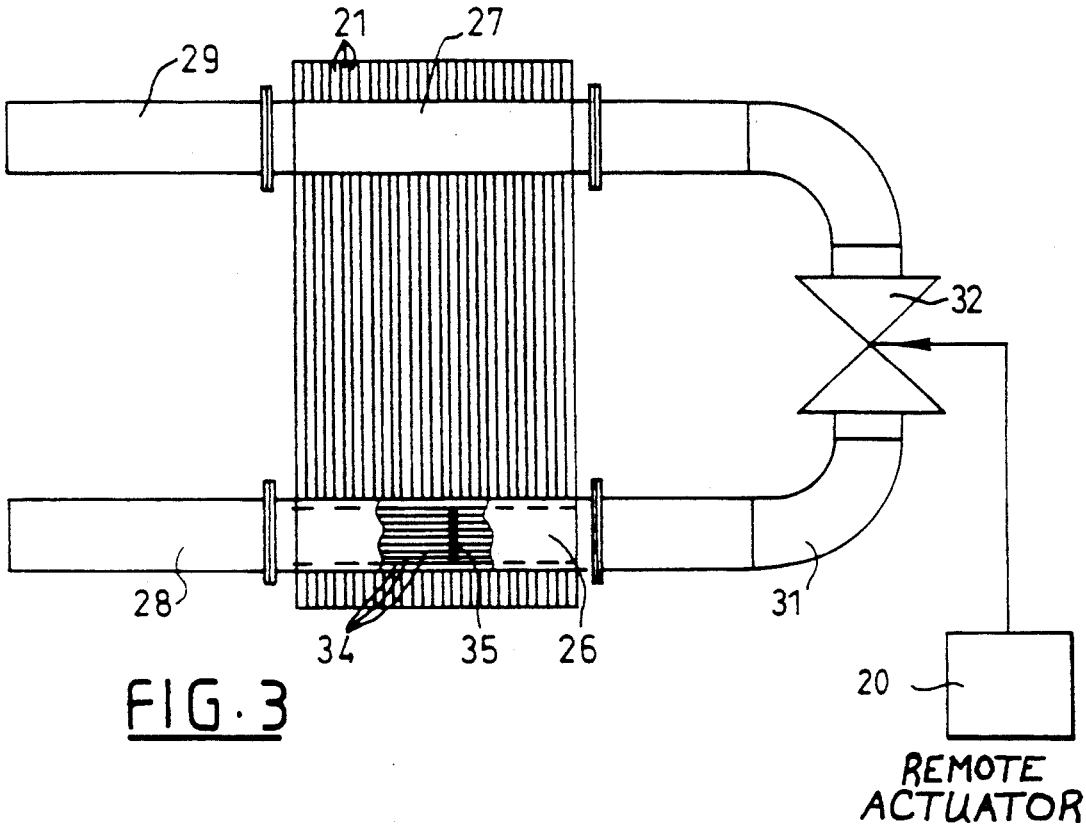
FIG. 3 is a side view of a plate heat exchanger in accordance with the present invention.

FIG. 3 is a view corresponding to FIG. 2 of a plate heat exchanger in accordance with the present invention.

For at least one of the fluid flow circuits, the normally closed end of the inlet manifold 26, that is to say its opposite end to that connected to the inlet pipework 28, is connected by a by-pass pipe 31 equipped with a valve 32 to the corresponding outlet pipework 29. Advantageously, this connection is produced by the fact that the pipe 31 in fact connects the normally closed ends of the manifolds 26 and 27.

Figure 7:
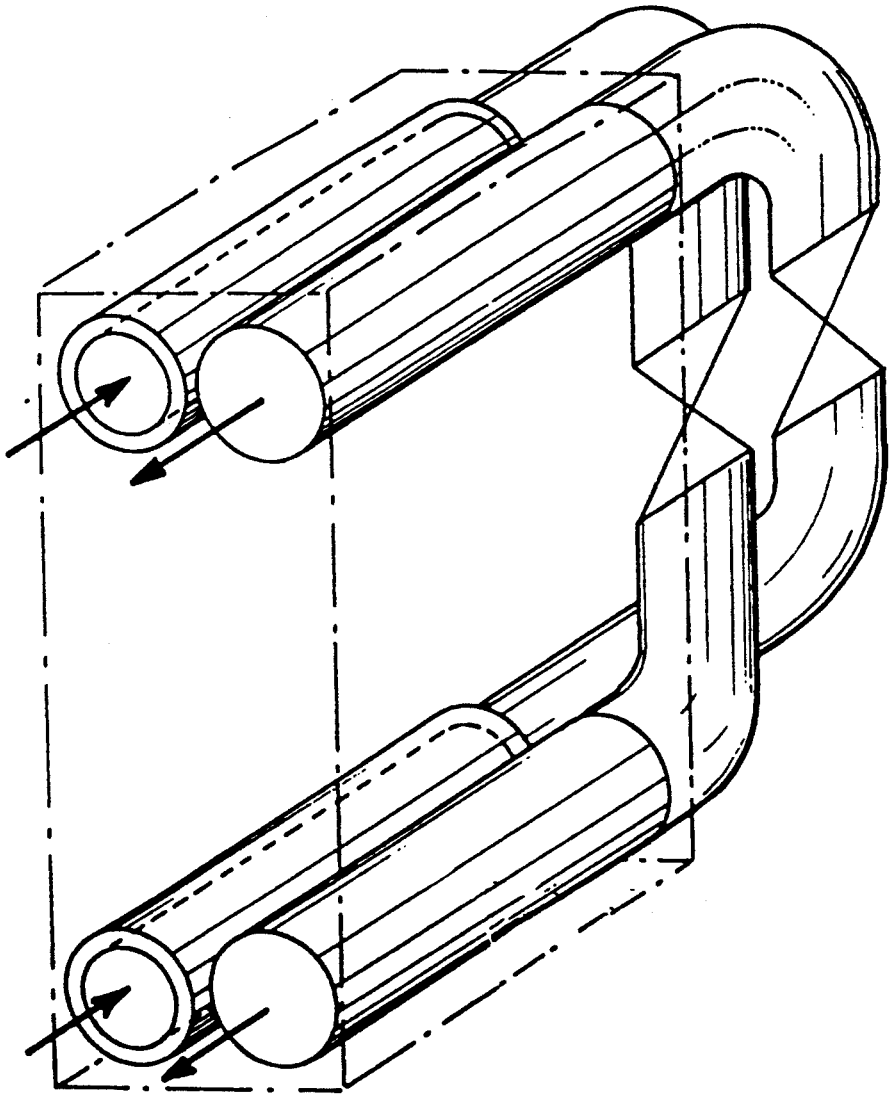
FIG. 7 is a perspective view of a third embodiment in which each of the two fluid flow circuits has a filtering element and a pipe for joining the inlet manifold to the outlet manifold.

As shown in FIG. 7, both fluid flow circuit may comprise a filtering cartridge and a pipe for joining the inlet manifold to the outlet manifold.

According to another characteristic of the invention, a cylindrical filtering cartridge 33 is placed inside the inlet manifold 26 against the internal wall of the manifold 26; this filtering cartridge is therefore placed between the manifold 26 and the flow channels which are linked to it.

Advantageously, the cross-section of the by-pass pipe 31 is at least equal to the cross-section of the manifold 6. This is necessary in the case where the size of the detritus is not negligible compared with that of the manifold.

It is also possible to consider a reduction in the cross-section of the pipe 31 with respect to the manifold, for example in order to limit the variation in flow rates in the circuit.

In addition, the opening area of the valve 32 is at least equal to the cross-section of the pipe 31.

The mesh size of the filtering cartridge 33 is at most equal to the distance separating two neighbouring plates, which corresponds to the thickness of the flow channels.

Figure 4:
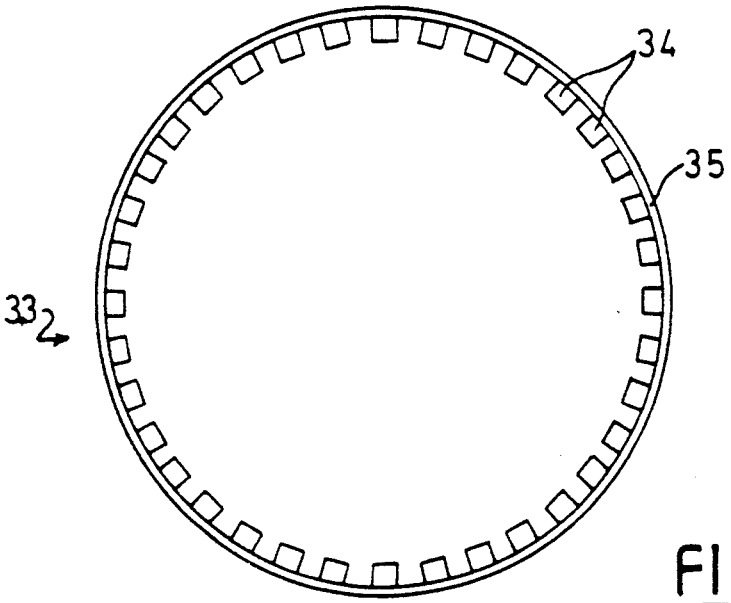
FIG. 4 is a detailed view showing the filtering cartridge.

FIG. 4 shows an embodiment of the filtering cartridge 33 of FIG. 2. It consists of an assembly of parallel rods 34 forming the generatrices of a cylinder. These rods have a square or rectangular cross-section and are held in an equidistant fashion by means of rings 35 placed regularly over the length of the filtering cartridge 33.

The distance between two contiguous rods 34 is less than or equal to the distance between two neighbouring plates. The external diameter of the rings 35 is slightly less than the diameter of the manifold 26. These holding rings are distributed in such a way that they do not obstruct the plates.

The exchanger which has just been described operates as follows. During normal operation, the valve 32 is closed and the liquid arriving in the manifold 26 via the inlet pipework 28 passes through the channels which are allocated to it and is collected by the manifold 27 and then discharged by the outlet pipework 29. The exchanger therefore operates in the same way as a plate heat exchanger of known type.

In the case of an exchanger used in the auxiliary cooling circuits of a power station, the cooling fluid consists of untreated water which may therefore contain impurities or debris and it is therefore the cooling circuit which comprises the device for preventing choking according to the invention.

The filtering cartridge 33 stops all the particles having dimensions which are greater than that of the thickness of the flow channels so that only the particles which can pass through the filtering cartridge flow with the fluid in the flow channels and are discharged by the outlet manifold 27 and the outlet pipe 29.

The result of this is that the only element of the exchanger which may be choked is the filtering cartridge 33. When this happens, or at regular intervals, during maintenance operations, the valve 32, which is advantageously remote controlled, by a remote actuator 20, as shown in FIG. 3 is opened and the untreated water then flows at great speed in the manifold 26, the pipe 31 and the manifold 27; the particles choking the filtering cartridge are carried away by this flow of fluid and are discharged. The valve 32 may then be closed again and the exchanger operates once more in a normal manner.

The fact that the filtering cartridge consists of rods placed along the length of the manifold means that the cartridge offers no resistance to flow, which facilitates the discharge of the waste particles choking it. The result of this is that the unchoking operation may be very quick, for example of the order of one minute.

The fact that the external diameter of the holding rings 35 is slightly less than the internal diameter of the manifold 26 enables this filtering cartridge to be easily installed in any manifold, without dismantling the exchanger. Consequently, existing exchangers may be easily and rapidly equipped with the unchoking device according to the invention.

In the case where the plates are not sufficiently well aligned to hold the cartridge, it will be possible for the latter to be held upstream by restricting the diameter of the inlet pipe element, which requires the exchanger to be dismantled.

In any case, it is advantageous that the diameter of the cartridge is less than that of the holes of the plates so as to compensate for the lack of alignment of the plates.

The ease of installing and dismantling the cartridge also enables it to be replaced should opening the valve 32 fail to unchoke it.

The additional elements used by the invention, namely the pipe 31 and the valve 32, are placed on the normally closed side of the plate heat exchanger so that no problem arises with regard to space requirements.

It is therefore clear that the invention makes it possible, at a relatively low cost, to prevent the plates of a plate heat exchanger from being choked; the only choked element, namely the filtering cartridge, may be unchoked extremely rapidly so that this unchoking operation may be carried out without halting the operation of the exchanger.

The above description has been given solely by way of an illustrative and in no way limiting example and variants or modifications may be made to it without departing from the scope of the present invention.

In particular, the output of the manifold 26 may be directly connected to the outlet pipework 29 without passing through the outlet manifold 27. Furthermore, a device for preventing choking may of course be placed on the two circuits of the exchanger if necessary.

Figure 6:
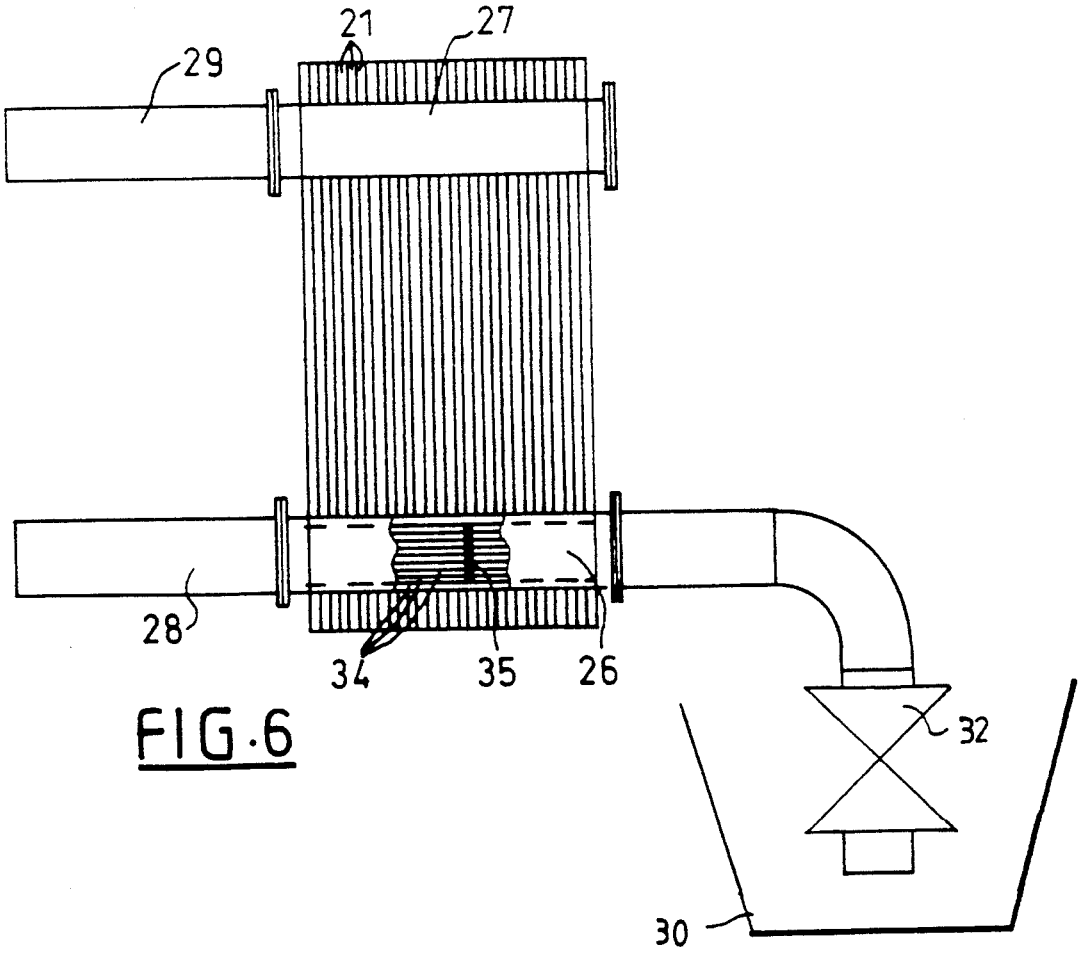
FIG. 6 is a side view of a third embodiment in which the cylindrical filtering element is connected to an emptying device.

According to another variant as shown in FIG. 6, the outlet of the manifold 26 is directly connected to an emptying device 30 such as a sewage network, without passing through the outlet manifold 27.

Figure 5:
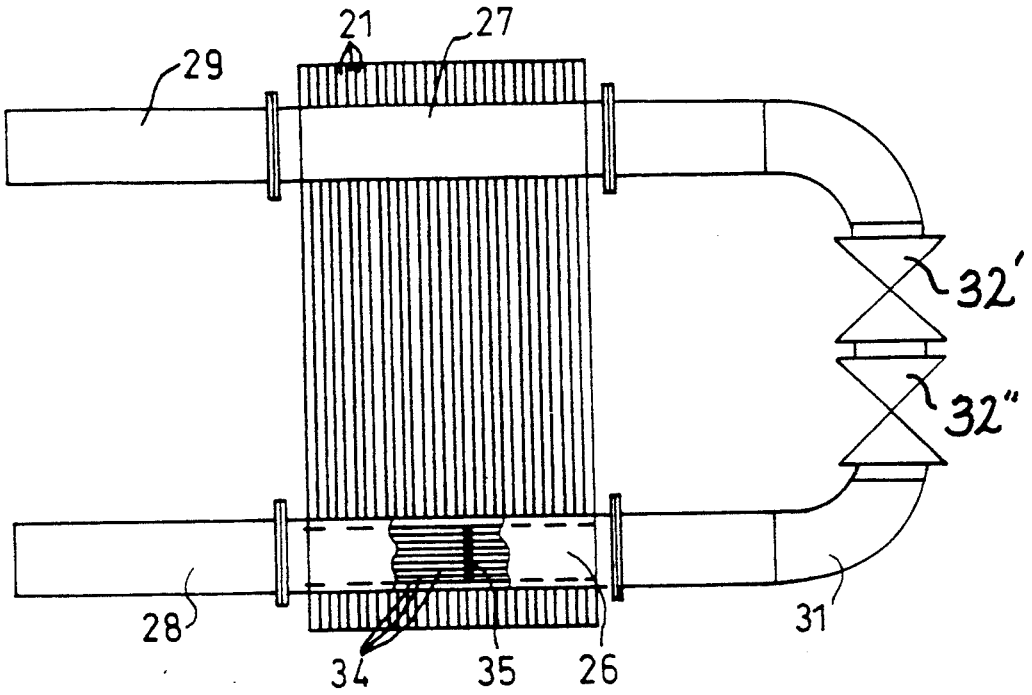
FIG. 5 is a side view, similar to FIG. 3, of another embodiment showing a joining pipe with two valves in series.

Furthermore, as shown in FIG. 5 two valves, 32' and 32'' may be placed in series on the pipe 31 in order to increase the reliability of the device.

I claim:

1. A plate heat exchanger consisting of a stack of plates (1; 21) clamped against each other in a sealed manner with sealing joints being intercalated so as to create fluid flow channels between said plates, each plate comprising four holes (2-5) forming with the holes of other of said plates four manifolds (6:7,26,27) namely two inlet manifolds and two outlet manifolds, said manifolds having ends connected, on one side of the stack, to inlet or outlet pipework (8,9;28,29), so as to create two distinct fluid circuits, the joints enabling the channels to communicate with one or the other of said fluid flow circuits, characterised in that at least one of the two inlet manifolds (26) is provided with a peripheral filtering cartridge (33) comprising a cylindrical mesh wall which is open at both ends thereof and which has a mesh size less than or equal to a distance between two contiguous plates (21), and is joined, at an end thereof opposite to the inlet pipework (28), to a corresponding outlet pipework (29) by a by-pass (31) controlled by a normally closed valve (32) or to an emptying device (30).

2. Plate heat exchanger according to claim 1, characterised in that said pipe (31) is connected to the opposite end of the outlet manifold (27) to the return pipework (29).

3. Plate heat exchanger according to claim 1, characterised in that the filtering cartridge (33) consists of a screen comprising rods (34) which are assembled by rings (35) and in that the distance separating two contiguous rods (34) is less than or equal to the distance between two contiguous plates (21).

4. Plate heat exchanger according to any one of claims 1 to 3, characterised in that the valve has a cross-section which is at least equal to that of the pipe (31).

5. Plate heat exchanger according to claim 4, characterised in that the valve (32) is remote controlled.

6. Plate heat exchanger according to claim 3 characterised in that the rods (34) have a square or rectangular cross-section.

7. Plate heat exchanger according to claim 3, characterised in that the distance between contiguous plates (21) is between 4 and 5 mm and in that the distance between two neighboring rods (34) is approximately 3 mm.

8. Plate heat exchanger according to claim 1, characterised in that each of the two fluid flow circuits comprises a filtering cartridge (33) and a pipe (31) for joining the inlet manifold to the outlet pipework.

9. Plate heat exchanger according to claim 1, characterised in that the by-pass pipe (31) comprises two valves in series.

10. The plate heat exchanger according to claim 1, wherein the by-pass pipe (31) has a cross-sectional area at least equal to that of an inlet manifold (26).

* * * * *